US006938543B2

(12) United States Patent
Inagaki et al.

(10) Patent No.: US 6,938,543 B2
(45) Date of Patent: Sep. 6, 2005

(54) WEB FED PRINTING MACHINE HAVING PASTING-RELATED MISREGISTRATION ELIMINATING APPARATUS

(75) Inventors: Takafumi Inagaki, Kawasaki (JP); Noriyuki Kasai, Kawasaki (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 10/843,634

(22) Filed: May 12, 2004

(65) Prior Publication Data

US 2005/0072327 A1 Apr. 7, 2005

(30) Foreign Application Priority Data

Oct. 3, 2003 (JP) ..... 2003-345311

(51) Int. Cl.[7] ..... B41F 5/16
(52) U.S. Cl. ..... 101/180; 101/181
(58) Field of Search ..... 101/180, 181, 101/211, 485–486; 358/1.14

(56) References Cited

U.S. PATENT DOCUMENTS

| | | | | |
|---|---|---|---|---|
| 5,377,964 A * | 1/1995 | Haller | ..... | 270/21.1 |
| 5,743,184 A * | 4/1998 | Skudrzyk | ..... | 101/181 |
| 5,937,748 A * | 8/1999 | Leligdon et al. | ..... | 101/32 |
| 6,253,678 B1 * | 7/2001 | Wentworth | ..... | 101/181 |

FOREIGN PATENT DOCUMENTS

| | | | | |
|---|---|---|---|---|
| EP | 0835753 A1 * | 4/1998 | ..... | B41F 13/14 |
| JP | 56-5666 | 2/1981 | | |
| JP | 57-170761 | 10/1982 | | |
| JP | 1-135647 | 5/1989 | | |
| JP | 2695166 | 9/1997 | | |
| JP | 2700460 | 10/1997 | | |
| JP | 10-76637 | 3/1998 | | |
| JP | 2842121 | 10/1998 | | |
| JP | 11-129452 | 5/1999 | | |
| JP | 2002-273857 | 9/2002 | | |
| JP | 3377990 | 12/2002 | | |
| JP | 3386708 | 1/2003 | | |

* cited by examiner

*Primary Examiner*—Andrew H. Hirshfeld
*Assistant Examiner*—Wasseem H. Hamdan
(74) *Attorney, Agent, or Firm*—Westerman, Hattori, Daniels & Adrian, LLP

(57) ABSTRACT

A web fed printing machine includes a web path provided between two sequentially disposed printing units and a misregistration detector for detecting misregistration in superimposition printing performed by the printing units. During superimposition printing, cylinder fine-move mechanisms finely move corresponding plate cylinders based on detected misregistration in order to adjust the registration. A web path length modification mechanism is provided in the web path. A control unit is connected to the web path length modification mechanism, the misregistration detector, and a paster. When a pasting signal is generated, the plate cylinder fine-move mechanisms stop making registration adjustment. At predetermined timing, the misregistration detector detects misregistration in printing performed by the printing units. The web path length modification mechanism performs a misregistration elimination action based on detected misregistration. Subsequently, the plate cylinder fine-move mechanisms resume making registration adjustment, and the web path length modification mechanism performs a return action.

1 Claim, 2 Drawing Sheets

WEB FED PRINTING MACHINE HAVING PASTING-RELATED MISREGISTRATION ELIMINATING APPARATUS

BACKGROUND OF THE INVENTION

1. Field of the Invention

The present invention relates to a web fed printing machine including a misregistration eliminating apparatus for eliminating misregistration that arises in the process of superimposition printing performed by a preceding printing unit and a subsequent printing unit disposed separately from the preceding printing unit. More particularly, the invention relates to a web fed printing machine including a misregistration eliminating apparatus for eliminating misregistration that arises between an image printed by a preceding printing unit and an image printed by a subsequent printing unit disposed separately from the preceding printing unit after web rolls are spliced together through pasting in the process of superimposition printing performed by the printing units.

2. Description of the Related Art

Conventionally, a web fed printing machine includes a misregistration eliminating apparatus for eliminating misregistration that arises between an image printed by a preceding printing unit and an image printed by a subsequent printing unit, the printing units being disposed separately, after web rolls are spliced together through pasting in the process of superimposition printing performed by the printing units. Such a misregistration eliminating apparatus is disclosed in, for example, Japanese Patent Application Laid-Open (kokai) No. 57-170761.

The disclosed misregistration eliminating apparatus includes compensator roller means, which is disposed midway between two printing units and can increase or decrease the length of a web path. When a pasting end signal indicative of end of splicing of web rolls is generated, the compensator roller means operates in such a direction as to increase the web path length by a predetermined length. Subsequently, every time web is consumed by a predetermined length, the compensator roller means operates in such a direction as to decrease the web path length by a length obtained by dividing the increment (increase) in web path length by a certain integer. The compensator roller means continues the decremental action under automatic control until the increment in web path length is decreased to "0."

The above-mentioned increment in web path length, a decrement in web path length at every action of decreasing the web path length, and the length of web to be consumed between actions of decreasing the web path length can be set as appropriate in consideration of the type and quality of a web roll to be used.

The above control prevents occurrence of misregistration. Specifically, in the case where printing is performed on a portion of a web that is drown out from an outer peripheral portion of a web roll and thus exhibits a large degree of elongation, the web path length is increased in order to prevent occurrence of misregistration which could otherwise result from the large degree of elongation. In the case where printing is performed on a portion of the web that is drown out from an intermediate or central portion of the web roll and thus exhibits a small degree of elongation, the web path length is decreased in an appropriate number of decremental actions in accordance with the length of web drawn out from the web roll until the increment in web path length is decreased to "0," thereby preventing occurrence of misregistration which could otherwise result from gradual tendency of web run toward misregistration if printing was continued with the web path length left increased.

The disclosed misregistration eliminating apparatus performs the following control without confirmation of the condition of registration of printed images: after pasting, the length of the web path extending midway between a preceding printing unit and a subsequent printing unit is increased; subsequently, every time web is consumed by a constant length, the increment in the web path length is decreased by a length obtained by dividing the increment in the web path length by a certain integer. Furthermore, control items; specifically, an increment in web path length, a decrement in web path length at a single action of decreasing the web path length, and the length of web to be consumed between start of an action of decreasing the web path length and start of the subsequent action of decreasing the web path length are set as appropriate in consideration of the type and quality of a web roll to be used.

Thus, obtaining printed images with high accuracy of registration is almost impossible. Even when a target accuracy of registration is lowered slightly, parameters that must be considered when the above-mentioned control items are to be set are not limited to the type and quality of a web roll to be used, but further include temperature and humidity at the time of work. Therefore, a very high level of skill is required.

SUMMARY OF THE INVENTION

An object of the present invention is to solve the above-mentioned problems in the conventional web fed printing machine.

Specifically, an object of the present invention is to provide a web fed printing machine configured such that, when a paster generates a pasting signal, register means are caused to stop making registration adjustment; a misregistration detector is caused to detect the degree of misregistration between a preceding printing unit and a subsequent printing unit; web path length modification means is caused to perform a misregistration elimination action on the base of the detected degree of misregistration; and upon completion of the misregistration elimination action, the register means are caused to resume making registration adjustment, and the web path length modification means is caused to perform a return action.

In other words, an object of the present invention is to provide a web fed printing machine which allows any operator, regardless of skill level, to accurately, promptly, and readily cope with a relatively large change in the condition of registration that occurs immediately after pasting, to thereby prevent impairment in printing quality and in which, when the web path length is gradually returned to its original length after completion of the pasting-related misregistration elimination action, register means resume making registration adjustment, so that printing can be performed while high accuracy of registration is maintained.

To achieve the above object, a web fed printing machine of the present invention comprises a web feed unit having a paster and capable of splicing web rolls by means of pasting; a plurality of printing units provided separately from one another, each of the printing units having register means for finely moving a plate cylinder; a web path for guiding a web provided at least between a pair of sequentially disposed printing units among the plurality of printing units; and a misregistration detector for detecting the degree of misregistration of printed images on the web after completion of superimposition printing performed by the sequentially disposed printing units. The web fed printing machine can perform superimposition printing on the web while, in order to make registration adjustment, finely moving the plate cylinders by use of the corresponding register means on the basis of the degree of misregistration detected by the misregistration detector.

The web fed printing machine further comprises web path length modification means provided in the web path and operable by means of a drive motor so as to modify the length of the web path; and control means connected to the web path length modification means, to the misregistration detector, and to the paster.

The control means comprises (a) an action pattern specifying section having a first storage section, which relationally contains the degree of misregistration between an image printed by a preceding printing unit and an image printed by a subsequent printing unit in the process of superimposition printing performed by the printing units and misregistration elimination action patterns to be followed by the web path length modification means in order to eliminate the misregistration and which further contains return action patterns to be followed by the web path length modification means in order to perform a return action sufficiently slowly as compared with misregistration elimination actions; (b) a rotational action specifying section having a second storage section, which relationally contains action patterns to be specified by means of an output signal from the action pattern specifying section and rotational actions of the drive motor of the web path length modification means; and (c) a motor driver for running the drive motor of the web path length modification means.

The action pattern specifying section is connected to the paster and to the misregistration detector. In response to a pasting signal generated from the paster, the action pattern specifying section causes the misregistration detector, at predetermined timing, to detect the degree of misregistration between an image printed by a preceding printing unit and an image printed by a subsequent printing unit in the process of superimposition printing. The action pattern specifying section selects a misregistration elimination action pattern for the web path length modification means from among those stored in the first storage section on the basis of the detected degree of misregistration and outputs an elimination pattern signal corresponding to the selected misregistration elimination action pattern. After completion of an action of the web path length modification means corresponding to the selected misregistration elimination action pattern, the action pattern specifying section selects a return action pattern for the web path length modification means from among those stored in the first storage section and outputs a return pattern signal corresponding to the selected return action pattern at predetermined timing.

The rotational action specifying section selects a rotational action for the drive motor from among those stored in the second storage section on the basis of an output signal from the action pattern specifying section and outputs a signal corresponding to the selected rotational action. The motor driver outputs a motor drive signal in order to run the drive motor of the web path length modification means on the basis of a signal output from the rotational action specifying section.

Each of the register means is configured in such a manner as to stop making registration adjustment when the paster generates a pasting signal and to resume making registration adjustment when the web path length modification means completes a misregistration elimination action, whereby elimination of pasting-caused misregistration between an image printed by a preceding printing unit and an image printed by a subsequent printing unit in the process of superimposition printing performed by the sequentially disposed printing units can be performed separately from registration adjustment that is performed in the process of regular printing.

The present invention allows, in printing performed by a web fed printing machine, any operator, regardless of skill level, to accurately, promptly, and readily cope with a relatively large change in the condition of registration that occurs immediately after pasting, to thereby prevent impairment in printing quality. Also, the present invention allows the web fed printing machine to cope with a change in the condition of registration that arises in the process of subsequent regular printing, so that printing can be readily performed, with high accuracy of registration being maintained, and thus printed matter having high quality can be continuously yielded.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

A web fed printing machine according to an embodiment of the present invention will next be described in detail with reference to the drawings.

Figure 1:
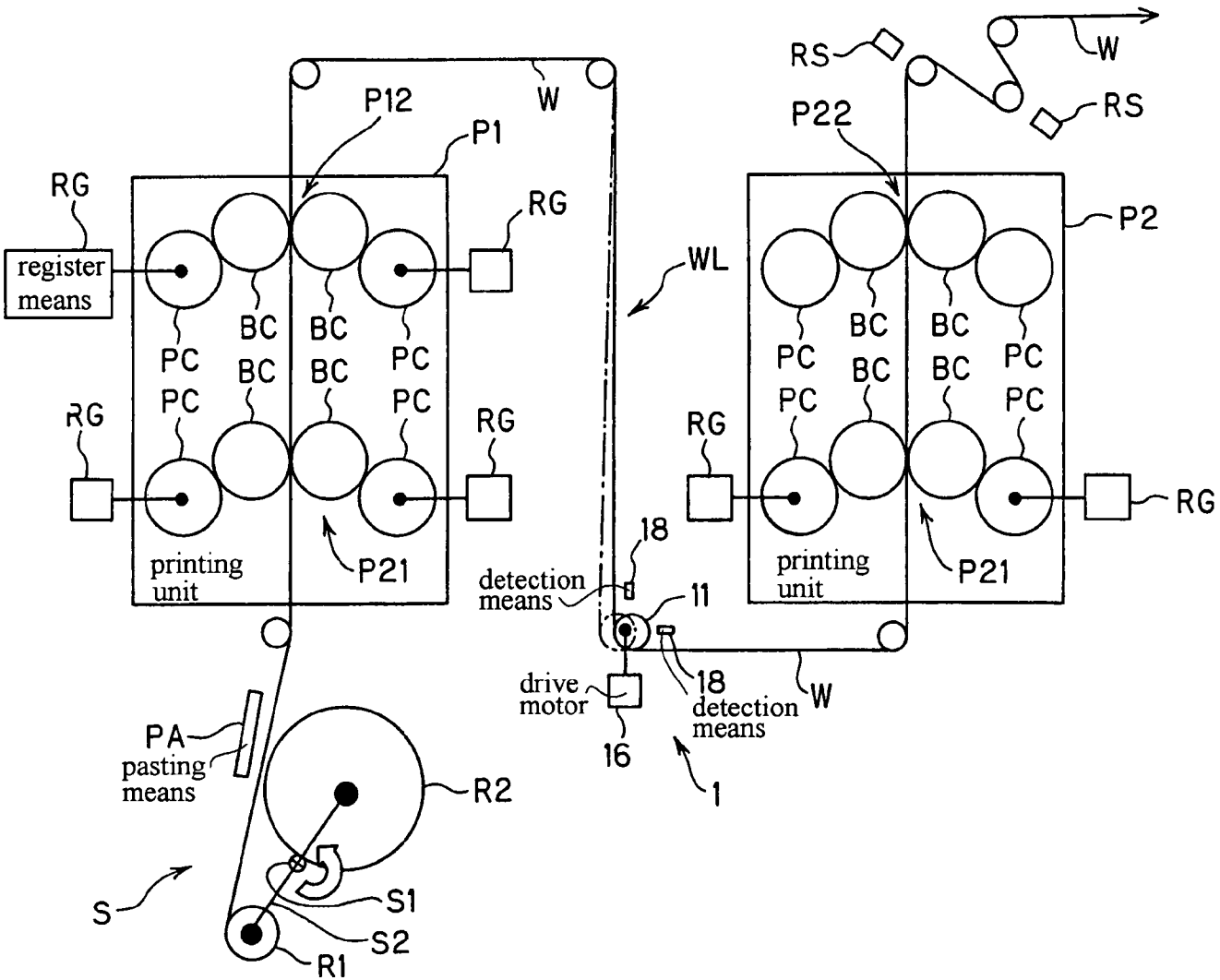
FIG. 1 is a schematic configuration diagram showing a web fed printing machine according to an embodiment of the present invention.

The web fed printing machine of FIG. 1 includes at least a single web feed unit S, which can rotatably support a plurality (two in FIG. 1) of web rolls (R1 and R2 in FIG. 1); at least two printing units P1 and P2; unillustrated processing units, such as a folding unit; and a web path WL, which guides, to the printing unit P2, a web W that has been drawn out from the web roll R1 (R2) on the web feed unit S and has passed through the printing unit P1. The web path WL includes web path length modification means 1, which can modify the length of the web path WL.

In the web feed unit S, two opposed support arms S2 (one of which is unillustrated in FIG. 1) are rotatably attached at their centers to corresponding opposite ends of a rotary support shaft S1. The support arms S2 rotatably support the web roll R1 between their one ends and the web roll R2 between their other ends.

The web fed printing machine further includes a paster PS having pasting means PA. When the volume of web remaining on the web roll R1 of preceding use reaches a predetermined value, the pasting means PA pastes the starting end of the standby web roll R2 onto the web of the web roll R1, whereby the web W can be continuously fed.

In the embodiment illustrated in FIG. 1, the printing unit P1 has printing sections P11 and P12, and the printing unit P2 has printing sections P21 and P22. Each of the printing sections P11, P12, P21, and P22 has two printing couples, each consisting of a plate cylinder PC and a blanket cylinder BC. The opposed blanket cylinders BC rotate in contact with each other while the web W is traveling therebetween, whereby printing is performed on opposite sides of the web W.

The web path WL is disposed between the printing units P1 and P2 in order to guide the web W from the printing unit P1 to the printing unit P2.

The web W undergoes superimposition printing on its opposite sides in the printing sections P11 and P12 of the printing unit P1; is guided to the printing unit P2 by the web path WL; and further undergoes superimposition printing on its opposite sides in the printing unit P2.

The printing section P22 prints a reference image. Register means RG of a registration adjuster RA are provided for the corresponding plate cylinders PC of the printing sections P11, P12, and P21 in order to align respective printed images with the reference image printed by the printing section P22. A misregistration detector RC having detection means RS is provided downstream of the printing section P22 in relation to the traveling direction of the web W. Each of the register means RG of the registration adjuster RA operates in accordance with a misregistration correction signal that is generated on the basis of the misregistration detected by the misregistration detector RC; i.e., misregistration of an image printed by each of the printing sections P11, P12, and P21 in relation to the printed reference image. In this manner, misregistrations of the printed images in relation to the printed reference image are eliminated.

The web path WL—disposed between the printing units P1 and P2 and adapted to guide the web W from the printing unit P1 to the printing unit P2—has the web path length modification means 1.

Immediately after pasting in the web feed unit S, the web W that differs in physical properties from the previously traveling web W is guided along the web path WL, which is provided between the printing unit P1 and the printing unit P2 and has a relatively long length. In some cases, this may cause occurrence of a relatively large degree of misregistration in the traveling direction of the web W between an image printed by the printing unit P1 and an image printed by the printing unit P2.

The web path length modification means 1 is configured so as to modify the length of the web path WL at a single stroke in order to cope with the occurrence of a relatively large degree of misregistration between an image printed by the printing unit P1 (preceding printing unit) and an image printed by the printing unit P2 (subsequent printing unit). Modification of the length of the web path WL modifies timing in which an image printed by the printing unit P1 reaches the contact zone of the two blanket cylinders BC of each of the printing sections P21 and P22 of the printing unit P2.

Figure 2:
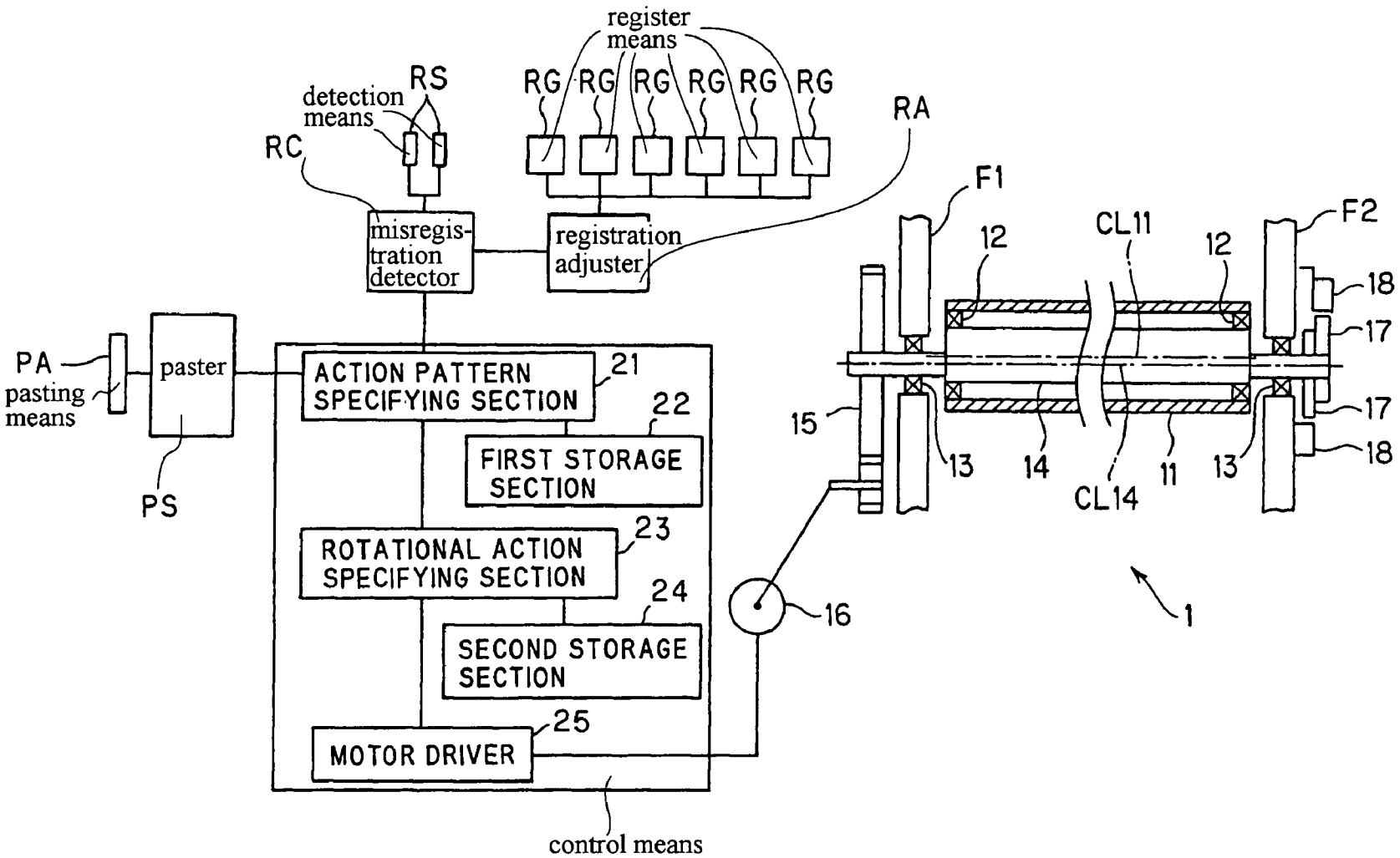
FIG. 2 is a schematic configuration diagram showing web path length modification means provided in the web fed printing machine of FIG. 1 and a control unit for controlling the web path length modification means.

The web path length modification means 1 is provided in the web path WL and includes, for example, as shown in FIG. 2, a support shaft 14, which is supported rotatably or in an angularly movable manner at its opposite ends by corresponding opposite frames F1 and F2 via corresponding bearings 13; and a guide roller 11, which is supported rotatably at its opposite ends on the support shaft 14 via corresponding bearings 12 and whose outer circumferential surface guides the web W that travels from the printing unit P1 to the printing unit P2.

One end portion of the support shaft 14 projects from the frame F1 and is connected to a drive motor 16 (a stepping motor in the present embodiment)-whose operation is controlled by control means 2—via a transmission mechanism that includes a gear 15 attached to the projecting end portion of the support shaft 14. The other end portion of the support shaft 14 projects from the frame F2. Two to-be-detected members 17 used to set the web path length modification means 1 to the position of its origin are attached to the projecting other end portion of the support shaft 14 while forming a phase difference of 90 degrees therebetween about a rotation axis CL14 of the support shaft 14.

Two origin detection means 18 are attached to the outside (right-hand surface in FIG. 2) of the frame F2 in such a manner as to be able to simultaneously detect the two to-be-detected members 17. The support shaft 14 is formed as an eccentric shaft in relation to the guide roller 11; i.e., the rotation axis CL14 of the support shaft 14 does not coincide with a rotation axis CL11 of the guide roller 11.

As shown in a left-hand half portion of FIG. 2, the control means 2 includes an action pattern specifying section 21; a rotational action specifying section 23 connected to the action pattern specifying section 21; a motor driver 25 connected to the rotational action specifying section 23; a first storage section 22 connected to the action pattern specifying section 21; and a second storage section 24 connected to the rotational action specifying section 23.

The first storage section 22 relationally contains the degree of misregistration between an image printed by the printing unit P1 and an image printed by the printing unit P2 and misregistration elimination action patterns to be followed by the web path length modification means 1 in order to eliminate the misregistration and further contains return action patterns to be followed by the web path length modification means 1 in order to perform a return action sufficiently slowly as compared with misregistration elimination actions. The second storage section 24 relationally contains action patterns to be specified by means of an output signal from the action pattern specifying section 21 and rotational actions of the drive motor 16 of the web path length modification means 1.

The action pattern specifying section 21 is connected to the misregistration detector RC and to the paster PS. The misregistration detector RC is connected to the registration adjuster RA.

The respective sections of the control means 2 operate as described below.

(1) In response to a pasting signal generated from the paster PS, the action pattern specifying section 21 (a) causes the misregistration detector RC to detect the degree of misregistration between an image printed by the printing unit P1 and an image printed by the printing unit P2 at predetermined timing; (b) selects a misregistration elimination action pattern for the web path length modification means 1 from among those stored in the first storage section 22 on the basis of the detected degree of misregistration; (c) outputs an elimination pattern signal corresponding to the selected misregistration elimination action pattern to the rotational action specifying section 23; (d) selects a return action pattern for the web path length modification means 1 from among those stored in the first storage section 22 after completion of an action of the web path length modification means 1 corresponding to the selected misregistration elimination action pattern; and (e) outputs a return pattern signal corresponding to the selected return action pattern to the rotational action specifying section 23 at predetermined timing.

(2) The rotational action specifying section 23 (a) selects a rotational action for the drive motor 16 from among those stored in the second storage section 24 on the basis of an output signal from the action pattern specifying section 21;

and (b) outputs a signal corresponding to the selected rotational action to the motor driver 25.

(3) The motor driver 25 outputs a motor drive signal to the drive motor 16 of the web path length modification means 1 on the basis of a signal output from the rotational action specifying section 23, to thereby run the drive motor 16.

The above-described web fed printing machine is operated and runs as described below.

First, power to the web fed printing machine is turned ON. Then, the drive motor 16 of the web path length modification means 1 is manually started so as to set the web path length modification means 1 to the position of its origin, so that the web path WL provided between the printing unit P1 and the printing unit P2 is set to a reference length.

When the two origin detection means 18 simultaneously detect the two to-be-detected members 17, the drive motor 16 stops, thereby ending the above setting operation.

Alternatively, the web fed printing machine may be configured such that, when power to the web fed printing machine is turned ON, the operation of setting the web path WL to the reference length is automatically performed.

Next, threading is performed as follows. The web W drawn out from the web roll R1 supported by the web feed unit S is threaded through the printing unit P1. The web W is then guided to the printing unit P2 by means of the web path WL, which is provided between the printing unit P1 and the printing unit P2. After threading through the printing unit P2, the web W is guided such that its opposite sides face the corresponding detection means RS of the misregistration detector RC. Then, the web W is threaded to unillustrated processing units provided downstream of the detection means RS.

After completion of threading, the web fed printing machine is caused to start printing. The web fed printing machine performs printing on the web W while eliminating misregistration as follows. The misregistration detector RC obtains, from image data detected by the detection means RS, misregistration of an image printed by each of the printing sections P11, P12, and P21 in relation to an image printed by the printing section P22. The misregistration detector RC outputs a misregistration correction signal to each of the register means RG on the basis of the obtained misregistration. The register means RG finely move the corresponding plate cylinders PC in accordance with the respectively received misregistration correction signals, thereby eliminating misregistration.

When the volume of web remaining on the web roll R1 reaches a predetermined value as a result of progress of printing, the paster PS operates. Specifically, the pasting means PA presses the web W-which is drawn out from the web roll R1 and is traveling-against the circumferential surface of the web roll R2 that is rotated such that its circumferential speed is substantially equal to the traveling speed of the traveling web W. The traveling web W is pasted onto the starting end of the web roll R2 by means of adhesive that is applied beforehand to the starting end.

As a result of pasting, the web W that differs in physical properties from the previously traveling web W; for example, the web W that is drown out from an outer peripheral portion of the web roll R2 and exhibits relatively inconsistent elongation in relation to tension, travels through the web fed printing machine. In some cases, when the web W travels along the relatively long web path WL provided between the printing units P1 and P2, the behavior of the web W, such as elongation due to tension applied in the traveling direction to the web W, changes drastically.

Thus, a relatively large degree of misregistration that cannot be eliminated by the register means RG or that takes the register means RG a long time to eliminate arises between an image printed by the printing unit P1 and an image printed by the printing unit P2.

When such a large degree of misregistration arises, the web path length modification means 1 is operated so as to modify the length of the web path WL at a single stroke, thereby modifying timing in which an image printed by the printing unit P1 reaches the contact zone of the two blanket cylinders BC of each of the printing sections P21 and P22 of the printing unit P2 and thus eliminating the misregistration.

Specifically, upon reception of a pasting signal output from the paster PS, the action pattern specifying section 21 outputs a signal to the misregistration detector RC so as to cause the misregistration detector RC to stop outputting a misregistration correction signal to the register means RG, thereby deactivating the misregistration elimination function of the register means RG. At predetermined timing after the pasting signal is generated, the action pattern specifying section 21 causes the misregistration detector RC to detect the degree of misregistration between an image printed by the printing unit P1 and an image printed by the printing unit P2.

The pasting signal causes the control means 2 to enter the state for waiting for a signal from the misregistration detector RC.

The misregistration detector RC obtains the degree of misregistration between an image printed by the printing unit P1 and an image printed by the printing unit P2 in accordance with a predetermined rule. For example, the misregistration detector RC averages the degree of misregistration between an image printed by the printing section P11 and an image printed by the printing section P22 in a plurality of image data detected by the detection means RS; takes the thus-obtained average degree of misregistration as the degree of misregistration between an image printed by the printing unit P1 and an image printed by the printing unit P2; and outputs a signal indicative of the degree of misregistration to the action pattern specifying section 21 of the control means 2.

Upon reception of the signal indicative of the degree of misregistration between an image printed by the printing unit P1 and an image printed by the printing unit P2, the action pattern specifying section 21 selects a misregistration elimination action pattern corresponding to the received degree of misregistration for the web path length modification means 1 from among those stored in the first storage section 22 and outputs an elimination pattern signal corresponding to the selected misregistration elimination action pattern to the rotational action specifying section 23.

Upon reception of the elimination pattern signal, the rotational action specifying section 23 selects a rotational action corresponding to a misregistration elimination action pattern specified by the received elimination pattern signal for the drive motor 16 of the web path length modification means 1 from among those stored in the second storage section 24 and outputs a rotational action signal corresponding to the selected rotational action to the motor driver 25.

Upon reception of the rotational action signal, the motor driver 25 outputs a motor drive signal to the drive motor 16 of the web path length modification means 1 in order to cause the drive motor 16 to perform a rotational action corresponding to the received rotational action signal.

Upon reception of the motor drive signal, the drive motor 16 rotates in accordance with the motor drive signal, thereby angularly moving the support shaft 14 of the web path length modification means 1 via the transmission mechanism including the gear 15. The angular movement of the support shaft 14 causes a move of the guide roller 11, thereby modifying, at a single stroke, the length of the web path WL provided between the printing unit P1 and the printing unit P2.

After pasting, as a starting end portion of the web roll R2, which exhibits relatively inconsistent elongation in relation to tension, is consumed, the elongation in relation to tension of the traveling web W gradually becomes that peculiar to the web W; i.e., that of the web W that has been used before pasting.

In order to cope with the above-mentioned change in elongation, after the length of the web path WL is modified at a single stroke; specifically, after predetermined time elapses from a point of time corresponding to the trailing edge of a signal for running the drive motor 16 in order to modify the length of the web path WL at a single stroke, the action pattern specifying section 21 of the control means 2 selects a return action pattern for the web path length modification means 1 from among those stored in the first storage section 22 and outputs a return pattern signal corresponding to the selected return action pattern to the rotational action specifying section 23.

Upon reception of the return pattern signal, the rotational action specifying section 23 selects a rotational action corresponding to a return action pattern specified by the received return pattern signal for the drive motor 16 of the web path length modification means 1 from among those stored in the second storage section 24 and outputs a rotational action signal corresponding to the selected rotational action to the motor driver 25.

Upon reception of the rotational action signal, the motor driver 25 outputs a motor drive signal to the drive motor 16 of the web path length modification means 1 in order to cause the drive motor 16 to perform a rotational action corresponding to the received rotational action signal.

Upon reception of the motor drive signal, the drive motor 16 rotates in accordance with the motor drive signal very slowly; for example, 1/300 to 1/500 the speed at the time of modifying the length of the web path WL at a single stroke, thereby angularly moving the support shaft 14 of the web path length modification means 1 via the transmission mechanism including the gear 15. The angular movement of the support shaft 14 causes the guide roller ll-whose rotation axis CL11 is eccentrically located in relation to the rotation axis CL14 of the support shaft 14—to move back to the position of its origin, thereby gradually returning, to a reference length, the length of the web path WL provided between the printing unit P1 and the printing unit P2.

A signal indicative of the trailing edge of the signal for running the drive motor 16 in order to modify the length of the web path WL at a single stroke is input to the misregistration detector RC via the action pattern specifying section 21, thereby causing the misregistration detector RC to resume outputting a misregistration correction signal to the register means RG and thus reactivating the suspended misregistration elimination function of the register means RG. After an action of gradually returning the length of the web path WL to the reference length is started, the web fed printing machine performs printing while the misregistration elimination function of the register means RG maintains registration, until the next pasting is performed.

In the case where, after the pasting signal is output, the degree of misregistration between an image printed by the printing unit P1 and an image printed by the printing unit P2 that is detected by the misregistration detector RC does not reach a predetermined degree, the misregistration elimination function of the register means RG can eliminate the misregistration without need to use the web path length modification means 1.

Thus, when the action pattern specifying section 21 receives a signal indicative of the degree of misregistration equal to or smaller than a predetermined degree from the misregistration detector RC, the action pattern specifying section 21 immediately outputs a reset signal in order to immediately cause the misregistration detector RC to resume outputting a misregistration correction signal to the register means RG, thereby reactivating the misregistration elimination function of the register means RG and resetting the control means 2 to the state before output of the pasting signal to thereby prepare for the next pasting.

The control means 2 may assume a configuration different from that described above. Specifically, after the pasting signal is output and before the misregistration detector RC is caused to detect the degree of misregistration between an image printed by the printing unit P1 and an image printed by the printing unit P2, the web path length modification means 1 is operated so as to preliminarily modify the length of the web path WL by a length that is empirically predetermined. In this case, after the length of the web path WL is preliminarily modified, the web path length modification means 1 is operated in a manner similar to that described above.

However, in this case, when the degree of misregistration between an image printed by the printing unit P1 and an image printed by the printing unit P2 that is detected by the misregistration detector RC does not reach a predetermined degree, a reset signal is output in order to reactivate the misregistration elimination function of the register means RG. Also, the preliminarily modified length of the web path WL is returned to the reference length.

Specifically, upon reception of a signal indicative of the degree of misregistration equal to or smaller than a predetermined degree from the misregistration detector RC, the action pattern specifying section 21 allows predetermined time to elapse and then selects a return action pattern from among those stored in the first storage section 22 for the web path length modification means 1 to make a return from the preliminary modification action that the web path length modification means 1 has performed in order to preliminarily modify the length of the web path WL. The action pattern specifying section 21 outputs a return pattern signal corresponding to the selected return action pattern to the rotational action specifying section 23.

Upon reception of the return pattern signal, the rotational action specifying section 23 selects a rotational action corresponding to a return action pattern specified by the received return pattern signal for the drive motor 16 of the web path length modification means 1 from among those stored in the second storage section 24 and outputs a rotational action signal corresponding to the selected rotational action to the motor driver 25.

Upon reception of the rotational action signal, the motor driver 25 outputs a motor drive signal to the drive motor 16 of the web path length modification means 1 in order to cause the drive motor 16 to perform a rotational action corresponding to the received rotational action signal. The drive motor 16 rotates in accordance with the motor drive signal very slowly; for example, 1/300 to 1/500 the speed at the time of preliminarily modifying the length of the web path WL, thereby angularly moving the support shaft 14 of the web path length modification means 1 via the transmission mechanism including the gear 15. The angular movement of the support shaft 14 causes the guide roller 11 to move back to the position of its origin, thereby gradually returning, to a reference length, the length of the web path WL provided between the printing unit P1 and the printing unit P2.

As described above, the web fed printing machine of the present invention allows any operator, regardless of skill level, to accurately, promptly, and readily cope with a relatively large change in the condition of registration that occurs immediately after pasting, to thereby prevent impairment in printing quality. Also, after completion of the pasting-related misregistration elimination action, when the web path length is gradually returned to its original length, the register means resume making registration adjustment, so that printing can be performed, while high registration accuracy and thus high printing quality are maintained.

Obviously, numerous modifications and variations of the present invention are possible in light of the above teachings. It is therefore to be understood that within the scope of the appended claims, the present invention may be practiced otherwise than as specifically described herein.

What is claimed is:

1. A web fed printing machine comprising:

a web feed unit having a paster and capable of splicing web rolls by means of pasting;

a plurality of printing units provided separately from one another, each of the printing units having register means for finely moving a plate cylinder;

a web path for guiding a web provided at least between a pair of sequentially disposed printing units among the plurality of printing units; and a misregistration detector for detecting the degree of misregistration of printed images on the web after completion of superimposition printing performed by the sequentially disposed printing units;

the web fed printing machine being able to perform superimposition printing on the web while, in order to make registration adjustment, finely moving the plate cylinders by use of the corresponding register means on the basis of the degree of misregistration detected by the misregistration detector;

the web fed printing machine further comprising:

web path length modification means provided in the web path and operable by means of a drive motor so as to modify the length of the web path; and control means connected to the web path length modification means, to the misregistration detector, and to the paster;

wherein the control means comprises (a) an action pattern specifying section having a first storage section and connected to the paster and to the misregistration detector, the first storage section relationally containing the degree of misregistration of printed images formed through superimposition printing performed by the sequentially disposed printing units and misregistration elimination action patterns to be followed by the web path length modification means in order to eliminate the misregistration, the first storage section further containing return action patterns to be followed by the web path length modification means in order to perform a return action sufficiently slowly as compared with the misregistration elimination actions, in response to a pasting signal generated from the paster, the action pattern specifying section causing the misregistration detector, at predetermined timing, to detect the degree of misregistration between an image printed by a preceding printing unit and an image printed by a subsequent printing unit in the process of the superimposition printing, selecting a misregistration elimination action pattern for the web path length modification means from among those stored in the first storage section on the basis of the detected degree of misregistration, and outputting an elimination pattern signal corresponding to the selected misregistration elimination action pattern, the action pattern specifying section selecting a return action pattern for the web path length modification means from among those stored in the first storage section after completion of an action of the web path length modification means corresponding to the selected misregistration elimination action pattern, and outputting a return pattern signal corresponding to the selected return action pattern at predetermined timing; (b) a rotational action specifying section having a second storage section, the second storage section relationally containing action patterns to be specified by means of an output signal from the action pattern specifying section and rotational actions of the drive motor of the web path length modification means, the rotational action specifying section selecting a rotational action for the drive motor from among those stored in the second storage section on the basis of an output signal from the action pattern specifying section, and outputting a signal corresponding to the selected rotational action; and (c) a motor driver for outputting a motor drive signal in order to run the drive motor of the web path length modification means on the basis of a signal output from the rotational action specifying section; and each of the register means is configured in such a manner as to stop making registration adjustment when the paster generates the pasting signal and to resume making registration adjustment when the web path length modification means completes the misregistration elimination action, whereby elimination of pasting-caused misregistration between the image printed by the preceding printing unit and the image printed by the subsequent printing unit in the process of superimposition printing performed by the sequentially disposed printing units can be performed separately from registration adjustment that is performed in the process of regular printing.

* * * * *